United States Patent [19]

Parlman et al.

[11] 4,424,123

[45] Jan. 3, 1984

[54] ORE FLOTATION USING FULVENES

[75] Inventors: Robert M. Parlman; Lyle D. Burns; Clarence R. Bresson, all of Bartlesville, Okla.

[73] Assignee: Phillips Petroleum Company, Bartlesville, Okla.

[21] Appl. No.: 407,414

[22] Filed: Aug. 12, 1982

[51] Int. Cl.[3] ..... B03D 1/14

[52] U.S. Cl. ..... 209/166; 252/61

[58] Field of Search ..... 252/61; 209/166, 167

[56] References Cited

U.S. PATENT DOCUMENTS 2,944,666 7/1960 Bange et al. .

3,339,730 9/1967 Boutin et al. .

3,351,193 11/1967 Martinez .

4,022,686 5/1977 Arakatsu .

FOREIGN PATENT DOCUMENTS 102033 3/1938 Australia ..... 209/166

OTHER PUBLICATIONS

Denver Equip. Co., Bulletin No. R1-B3, pp. 10, 15.

*Primary Examiner*—Bernard Nozick

[57] ABSTRACT

Fulvene and hydrocarbyl substituted fulvenes are disclosed as mineral collectors for ore flotation processes, particularly for molybdenum sulfide recovery.

7 Claims, No Drawings

ORE FLOTATION USING FULVENES

This invention relates to ore flotation. More specifically the invention relates to the flotation of molybdenum ores.

BACKGROUND OF THE INVENTION

Flotation processes are known in the art and are used for recoverying and concentrating minerals from ores. In froth flotation processes the ore is crushed and wet ground to obtain a pulp. Additives such as mineral flotation or collecting agents, frothers, suppressants, stabilizers, etc. are added to the pulp to assist separating valuable materials from the undesired or gangue portions of the ore in subsequent flotation steps. The pulp is then aerated to produce a froth at the surface. The minerals which adhere to the bubbles or forth are skimmed or otherwise removed and the mineral bearing froth is collected and further processed to obtain the desired minerals. Typical mineral flotation collectors include xanthates, amines, alkyl sulfates, arene sulfonates, dithiocarbamates, dithiophosphates and thiols. Hydrocarbon oils such as fuel oil, kerosene, lubricating oil have also been described for use in ore flotation and particularly for the recovery of molybdenum sulfide.

While the art of ore flotation has reached a significant degree of sophistication it is a continuing goal in the ore recovery industry to increase the productivity and selectivity of ore flotation processes.

THE INVENTION

It is one object of this invention to provide a new flotation process which is particularly useful for molybdenum recovery.

Yet another object of this invention is to provide a new flotation agent.

A still further object of this invention is to improve molybdenum recovery from ores containing sulfided molybdenum mineral values.

These and other objects, advantages, details, features and embodiments of this invention will become apparent to those skilled in the art from the following detailed description of the invention and the appended claims.

In accordance with this invention it has now been found that fulvenes are useful flotation agents in the recovery of molybdenum.

FLOTATION PROCESS

Thus in accordance with one embodiment of this invention a flotation process is provided. This flotation process involves the steps of (a) mixing the mineral material with water and a fulvene to establish a pulp, (b) aerating the pulp to produce a froth and a tail product, (c) separating the froth and the tail product and (d) recovering minerals from the so separated froth and/or tail product.

The process steps here involved are conventional except for the novel use of the fulvene.

The amount of fulvene-type material used as a collector can be generally from about 0.005 pound per ton of ore to about 1 pound per ton of ore. Preferably the range will be from about 0.01 to 0.5 pound per ton of ore.

FROTHER

It is preferred in accordance with this invention to also employ a frother to enhance the formation of a froth during the aeration step. While many different frothers can be used in accordance with this invention, the preferred frother is a polyoxyalkylene glycol or a polyoxyalkylene glycol mono alkyl ether having molecular weights in the range of about 400 to about 1000, most preferably in the range of about 420 to about 780.

Typical examples representing these type materials are polypropylene glycol 400
polypropylene glycol 425
polypropylene glycol 750
polypropylene glycol 900
polybutylene glycol
polypentylene glycol along with the corresponding monomethyl and monoethyl ethers, as well as mixtures thereof. The numbers following the names are the average molecular weight of the products.

The amount of frothing agent employed will generally depend upon the amount of fulvene-type collector used. Usually the weight ratio of fulvene-compound to frothing agent will be from about 10:90 to 90:10, preferably however in the range of 6:1 to 3:1.

The frothing agent is generally employed in a quantity of 0.0005 to 0.9 pounds per ton of ore, preferably in the range of 0.001 to 0.45 pounds per ton of ore.

Although the individual ingredients such as frother and collector can be added separately to the flotation step it is presently preferred to add a mixture of the fulvene-type compound and the frother.

ORES

The flotation process of this invention is applicable to a variety of ores, preferably sulfided ores. Particularly for the separation and recovery of lead, zinc, nickel, cobalt, silver and gold ores the process of this invention can be used. Most preferably the process of this invention is used for the recovery of molybdenum in sulfided form. Examples of molybdenum-bearing ores are

| | |
|---|---|
| Molybdenite | $MoS_2$ |
| Wulfenite | $PnMoO_4$ |
| Powellite | $Ca(Mo,W)O_4$ |
| Ferrimolybdite | $Fe_2Mo_3O_{12}.8H_2O$ |

Molybdenum sulfide ores are the preferred ores for the application of the process of this invention.

FLOTATION PROCESS CONDITIONS

The process conditions employed in the flotation operation are conventional conditions. Typical ranges for these conditions are listed in the following table:

| | |
|---|---|
| Solids concentration in wt. % | 20 to 40 |
| Temperature, °F. | 50 to 100 |
| pH | 8.5 to 11.5 |
| Flotation time, minutes | 2 to 10 |
| Other additives | |
| Depressants | .05 to 5 lbs/ton |
| Promoters | .01 to .1 lbs/ton |
| pH Regulators | .1 to 3 lbs/ton |

FLOTATION COMPOSITION

Thus in accordance with a second embodiment of this invention a flotation composition is provided which comprises the following ingredients:

(a) fulvene compound represented by the formula

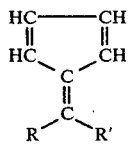

wherein R and R′ can be hydrogen or any hydrocarbyl radical such as alkyl, cycloalkyl, alkenyl, aryl, or alkaryl radicals having from 1 to 20 carbon atoms, and wherein R and R′ together with the carbon atom to which they are attached can together form a single cyclohydrocarbylidene group, such as cycloalkylidene, having 3 to 20 carbon atoms, as well as mixtures of such fulvene compounds, (b) a frother.

Examples of such fulvene hydrocarbon compounds are fulvene
methyl fulvene
dimethyl fulvene
ethyl methyl fulvene
diethyl fulvene
methyl hexyl fulvene
methyl decyl fulvene
methyl eicosyl fulvene
methyl allyl fulvene
dicyclohexyl fulvene
methyl phenyl fulvene
diphenyl fulvene
cyclohexylidenecyclopentadiene The fulvene hydrocarbons are generally known compounds. The preparation of such fulvenes is well known in the art. Typically the production of these fulvenes involves the reaction of cyclopentadiene and a ketone or an aldehyde in the presence of a condensation catalyst. Dimethyl fulvene is a commercially available product.

The following examples serve to further illustrate the invention as well as to show further preferred embodiments thereof without undue limitation to its scope.

EXAMPLE I

This example describes a standard ore flotation process procedure used to evaluate mining chemicals. The example includes two control runs and an inventive run used on a single ore type. To a ball mill was charged 2020 grams (2 weight percent moisture) of a crushed Mo/Fe-containing ore obtained from the Thompson Creek Mine, Custer County, Idaho. Also charged to the mill was 1000 grams of water, 1.25 grams lime and 11 drops (0.08 lb/ton) methyl isobutyl carbinol (MIBC) frother and the mixture ground for 27.5 minutes. The slurry was transferred to a 5 liter Denver flotation cell along with enough water to make about a 35 weight percent aqueous solids solution. The pH was 9. With air passing through the agitator, the mixture was floated for 6 minutes while being stirred at 1900 rpm. The foam was periodically removed and the total concentrate filtered, dried and analyzed. Another control run was made by repeating the flotation step except 0.18 lb/ton of an aromatic oil (PMCA, Phillips Petroleum Co.) was employed as a collector and was added at the grind stage. The flotation step was again repeated except the inventive collector, dimethyl fulvene, 0.18 lb/ton, was used as the collector instead of the PMCA aromatic oil. The dimethyl fulvene was prepared by treating a mixture of cyclopentadiene and acetone with an Amberlyst ® catalyst. The results are listed in Table I where it is shown the fulvene collector (invention) increases the Mo and Fe recovery compared to both controls, when no collector was used and where an aromatic oil was used as a collector.

TABLE I

Effect of Collector on Mineral Recovery
2020 grams Ore (Thompson Creek Mine)

| Collector | Tails, grams | | | Concentrate, grams | | | % Recovery | |
|---|---|---|---|---|---|---|---|---|
| (.18 lb/ton) | Wt. | Fe | Mo | Wt. | Fe | Mo | Fe | Mo |
| Control: | | | | | | | | |
| A. None | 1996 | 19.96 | .345 | 17.43 | .516 | 3.57 | 2.52 | 91.19 |
| B. PMCA[a] | 2002 | 22.02 | .144 | 13.57 | .642 | 4.09 | 2.83 | 96.60 |
| | 2008 | 19.08 | .132 | 12.45 | .588 | 3.40 | 3.00 | 96.26 |
| | | | | | Average = | | 2.92 | 96.43 |
| Invention: | | | | | | | | |
| C. Dimethyl | 2002 | 22.02 | .054 | 16.42 | 1.312 | 4.02 | 5.62 | 98.67 |
| Fulvene | 2003 | 19.03 | .052 | 15.31 | .934 | 4.17 | 4.68 | 98.77 |
| | | | | | Average = | | 5.15 | 98.72 |

[a]PMCA, an aromatic oil

EXAMPLE II

This example describes another flotation process similar to that described in Example I but with a different ore type. The example includes one control and one inventive run. To a table top ball mill was charged 1000 grams of a crushed Mo/Fe/Cu-containing ore obtained from the Climax Molybdenum Co., a division of Amax, Inc. Also charged to the mill was 500 grams water, 0.2 grams lime, 0.027 lb/ton pine oil, 0.05 lb/ton Syntex (monoglyceride of coconut oil), 0.66 lb/ton sodium silicate, 0.38 lb/ton vapor oil, 0.03 lb/ton Nokes Reagent (60% NaOH/40% $P_2S_5$—usually a 25 wt. % aqueous solution), and 0.005 lb/ton sodium cyanide and the mixture ground for 4 minutes 8 seconds. The slurry was transferred to a 2.5 liter Denver flotation cell along with enough water to make about a 35 weight percent aqueous solids solution. The pH was adjusted to 8.5. The agitator was started at 1100 rpm and the mixture was conditioned for 2 minutes and floated for 5 minutes. The concentrate float was filtered, dried and analyzed. The procedure was repeated except the vapor oil collector was replaced with the inventive collector dimethyl fulvene produced as described above. These results are listed in Table II where it can be seen that at the same concentration (i.e. 0.38 lb/ton) dimethyl fulvene increases Fe, Cu and Mo recoveries from 6.31, 27.53 and 84.27, respectively when vapor oil is used as a collector to 16.46, 36.49 and 87.10, respectively with the fulvene. The results also show that reducing the dimethyl fulvene concentration from 0.38 lb/ton to half, namely 0.19 lb/ton still gives good Mo recovery with even higher Fe and Cu recoveries.

TABLE II

Effect of Collector on Mineral Recovery
1000 grams Ore (Climax Molybdenum Co.)

| | Tails, grams | | | | Concentrate, grams | | | | % Recovery | | |
|---|---|---|---|---|---|---|---|---|---|---|---|
| | Wt. | Fe | Cu | Mo | Wt. | Fe | Cu | Mo | Fe | Cu | Mo |
| Control: | | | | | | | | | | | |
| 1. Vapor Oil, .38 lb/ton | 966 | 15.93 | .048 | .29 | 32.8 | 1.04 | .020 | 1.46 | 6.13 | 29.41 | 83.43 |
| | 974 | 15.97 | .058 | .28 | 33.7 | 1.11 | .020 | 1.60 | 6.50 | 25.64 | 85.11 |
| | | | | | | | | | 6.31 | 27.53 | 84.27 |
| Invention: | | | | | | | | | | | |
| 2. Dimethyl Fulvene, .38 lb/ton | 934 | 14.01 | .047 | .24 | 53.01 | 2.76 | .027 | 1.62 | 16.46 | 36.49 | 87.10 |
| .19 lb/ton | 943 | 14.15 | .047 | .28 | 56.80 | 4.60 | .034 | 1.70 | 24.53 | 41.97 | 85.86 |

Reasonable variations and modifications which will become apparent to those skilled in the art can be made in this invention without departing from the spirit and scope thereof.

What is claimed is:

1. A flotation agent comprising (a) a fulvene compound having the formula

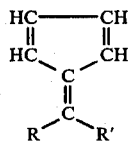

wherein R and R′ can be hydrogen or a hydrocarbyl radical having from 1 to 20 carbon atoms, and wherein R and R′ together with the carbon atom to which they are attached can together form a single cyclohydrocarbylidene group having 3 to 20 carbon atoms and mixtures of fulvenes, and (b) a frother.

2. Composition in accordance with claim 1 wherein said fulvene compound is dimethyl fulvene.

3. An ore flotation process comprising (a) mixing mineral material, water and one fulvene compound or a mixture of fulvene compounds represented by the formula

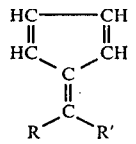

wherein R and R′ can be hydrogen or a hydrocarbyl radical having from 1 to 20 carbon atoms, and wherein R and R′ together with the carbon atom to which they are attached can together form a single cyclohydrocarbylidene group, such as cycloalkylidene, having 3 to 20 carbon atoms, (b) aerating said pulp to produce a froth and a tail product, (c) separating said froth and said tail product, and (d) recoverying mineral values from said froth.

4. Process in accordance with claim 3 wherein said ore is a molybdenum containing ore.

5. Process in accordance with claim 3 wherein said molybdenum ore is a molybdenum sulfide ore.

6. Process in accordance with claim 3 wherein said mineral material is crushed ore.

7. Process in accordance with claim 4 wherein said fulvene composition is employed in a quantity in the range of 0.005 lbs/ton mineral material to 1 lb/ton mineral material.

* * * * *